US005695145A

United States Patent [19]

Wacht et al.

[11] Patent Number: 5,695,145

[45] Date of Patent: Dec. 9, 1997

[54] METHOD OF UNWINDING FILMSTRIP FROM A SPIRAL PROCESSING REEL

[75] Inventors: Peter A. Wacht, Ontario; James F. Schmitt, Fairport, both of N.Y.

[73] Assignee: Eastman Kodak Company, Rochester, N.Y.

[21] Appl. No.: 694,550

[22] Filed: Aug. 9, 1996

[51] Int. Cl.[6] ..... B65H 18/08

[52] U.S. Cl. ..... 242/348; 242/536; 242/602.3

[58] Field of Search ..... 242/348, 348.3, 242/536, 602, 602.3

[56] References Cited

U.S. PATENT DOCUMENTS

| | | | |
|---|---|---|---|
| 2,125,285 | 8/1938 | Draeger | 242/603 |
| 2,594,980 | 4/1952 | Neuwirth | 242/536 |
| 2,595,898 | 5/1952 | Siedenburg | 242/602.3 |
| 2,710,727 | 6/1955 | Orowick | 242/580 |
| 2,711,864 | 6/1955 | Windman | 242/602.3 |
| 2,756,005 | 7/1956 | Franke | 242/536 |
| 4,448,365 | 5/1984 | Petsching et al. | 242/580 |
| 4,834,306 | 5/1989 | Robertson et al. . | |
| 5,093,686 | 3/1992 | Shigaki . | |
| 5,445,336 | 8/1995 | Pagano | 242/348.3 |
| 5,543,882 | 8/1996 | Pagano et al. . | |
| 5,547,145 | 8/1996 | Pagano et al. | 242/536 |

*Primary Examiner*—John P. Darling
*Attorney, Agent, or Firm*—Frank Pincelli

[57] ABSTRACT

A method of retracting a filmstrip wound on a filmstrip reel. The filmstrip has a rear end which is attached to a spool of a film cartridge. The filmstrip reel comprising a pair of side walls, each side wall having a spiral track for retaining an edge of the filmstrip. The filmstrip is rewound into the film cartridge by applying a removing force on the rear end of the filmstrip in a direction for rewinding the filmstrip into the films cartridge. At the same time, one of the side walls is oscillated with respect to the other side wall about its central axis.

3 Claims, 8 Drawing Sheets

METHOD OF UNWINDING FILMSTRIP FROM A SPIRAL PROCESSING REEL

FIELD OF THE INVENTION

The present invention is directed to a method of removing a filmstrip from a processing reel used in photofinishing.

BACKGROUND OF THE INVENTION

Traditional methods for processing photosensitive filmstrips contained in cartridges typically involves the separation of the filmstrip from the cartridge prior to processing. In one method, the photographic filmstrip is cut away from the cartridge and taped to a leader board, or a length of flexible filmstrip, after which the filmstrip is drawn through a series of tanks containing the required processing solutions. This method has satisfied the reliability and efficiency requirements for the traditional photofinishing systems largely due to the fact that the filmstrip cartridge is discarded and thus no longer serves any other purposes in subsequent stages of image preparation, storage, and retrieval.

Recent advances in filmstrip cartridges, such as described in U.S. Pat. No. 4,834,306, disclose a photographic filmstrip cartridge wherein the filmstrip may be thrust out of the cartridge and retracted back into the cartridge a number of times (hereinafter referred to as thrust filmstrip cartridge). For example, the thrust filmstrip cartridge can be used as a primary storage for the processed filmstrip, and can be used with related filmstrip handling equipment which can be configured to accept the thrust-type filmstrip cartridge. The ability to execute other tasks involved in the preparation, storage, and retrieval of images from a specific filmstrip cartridge is advantageous to the photographer and to the photofinisher. In particular, the method of identifying, sorting, and preferentially reproducing (e.g., selecting desired print parameters; such as frame number, size, quantity, setup, and balancing data) images may be significantly enhanced. It has been proposed that the thrusting filmstrip be detached from the thrust filmstrip cartridge prior to chemical processing and processed in traditional photofinishing equipment and then reattached to the original filmstrip cartridge (or similar cartridge) for storage.

The detached method exhibits a number of inherent disadvantages. Specifically, the correct filmstrip and cartridge must be reunited; detaching and reattaching the filmstrip can result in damage to the leader and/or trailing edge of the filmstrip which then must be cut and reshaped which adds cost to the process; reattaching of the filmstrip can be difficult and require certain standardized equipment. Additionally, the detached system cannot take advantage of the fact that only partial portions of the filmstrip may be exposed and developed without exposing the remaining portion of the filmstrip in the cartridge.

U.S. Pat. No. 5,093,686 discloses the processing of photosensitive material while the filmstrip is still connected to the filmstrip cartridge. This is accomplished by thrusting the filmstrip out of the cartridge and dipping the filmstrip into successive tanks, typically referred to as the dip and dunk process. The device includes a vertical transport mechanism for lifting the filmstrip up to a horizontal transport position where the filmstrip can then be moved horizontally while the filmstrip is still extended from the cartridge. This type of process results in the images at the bottom end of the strip to experience more development time than the portions above. Additionally, further expensive equipment is required to move and transport the filmstrip through the system.

A solution to the foregoing problem is disclosed in U.S. Pat. No. 5,543,882 and U.S. Ser. No. 08/330,400, filed Oct. 27, 1994, by Daniel M. Pagano and Kevin J. Klees, entitled AUTOMATIC PROCESSING REEL FOR USE IN PHOTOFINISHING, both of which are hereby incorporated by reference. These applications disclose a reel on which an undeveloped strip of film is wound and is transported through the processing system. The reel comprises a pair of spaced side walls, each of which have a spiral ridge (projection) which are aligned with respect to each other so as to form a spiral path for receiving of a filmstrip therein in a spiral pattern about the axis of the reel. These references also disclose several methods for disengaging a clutch mechanism for allowing the filmstrip to be withdrawn from the reel. One method simply discloses releasing the clutch mechanism which is used to drive the filmstrip into the reel so that the filmstrip can be withdrawn by rewinding of the filmstrip back into the cartridge. A second method disclosed utilizes a modified reel whereby oscillation of one of the side walls will cause the clutch to engage and drive the filmstrip back out of the reel. A third method disclosed involves moving the side walls of the reel apart for easy withdrawal of the filmstrip. The first method has the disadvantage in that the edges of the filmstrip often bind with the ridges of the side walls. The later two techniques require complex modifications to the reel and additional equipment to allow rewinding of the filmstrip. Thus, there is a need to provide a simple and economical way for allowing easy withdrawal of the filmstrip from the reel.

Applicants have invented an improved method for reducing friction forces between the filmstrip and the reel as the filmstrip is being withdrawn therefrom.

SUMMARY OF THE INVENTION

There is provided a method of retracting a filmstrip wound on a filmstrip reel, the filmstrip having a rear end attached to a spool of a film cartridge, the reel comprising a pair of side walls, each side wall having a spiral track for retaining an edge of the filmstrip, said method comprising the steps of:

a) applying a removing force on the rear end of the filmstrip in a direction for rewinding the filmstrip into the film cartridge; and b) oscillating one of the side walls with respect to the other side wall about its central axis simultaneously as the filmstrip is being rewound into the film cartridge.

DETAILED DESCRIPTION OF THE INVENTION

Figure 1:
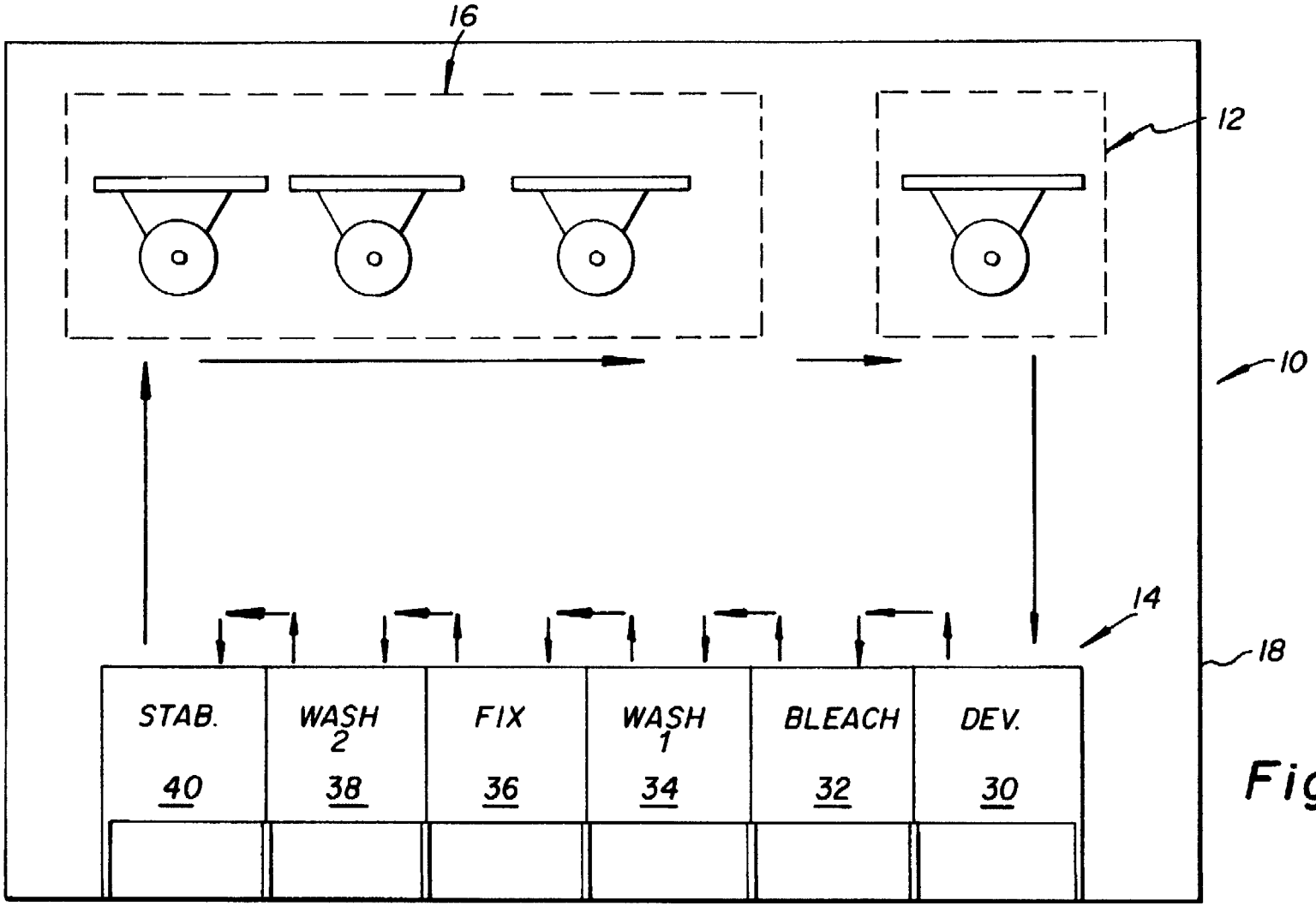
FIG. 1 is a diagrammatic representation of an apparatus made in accordance with the present invention.

Referring to FIG. 1, there is illustrated a processing apparatus 10 made in accordance with the present invention. The apparatus 10 is designed to process photosensitive material, such as photographic filmstrip. In the particular embodiment illustrated, the apparatus is particularly adapted for processing photosensitive filmstrip that has been provided in a thrust-type filmstrip cartridge, such as disclosed in U.S. Pat. No. 4,834,306, commonly assigned to the assignee of the present application and which is hereby incorporated by reference. The apparatus 10 includes a load/unload station 12, a filmstrip processing section 14, and a drying section 16. At the load/unload station 12 a filmstrip from a filmstrip cartridge is initially driven out of the cartridge into a processing reel and after processing back into the cartridge, as is discussed in greater detail later herein. As is typical with such processing apparatus, a housing 18 is provided for containing the load/unload station, filmstrip processing section, and drying section and for providing a light-tight environment within the housing 18. Housing 18 is appropriately sized and configured so as to fully enclose the components and allow access as required. A detailed description of the apparatus 10 and its operation is described in U.S. Pat. No. 5,543,882, which has previously been incorporated herein by reference. The apparatus 10 is designed such that it is possible to process filmstrip while the filmstrip is still attached to a filmstrip cartridge.

Figure 2:
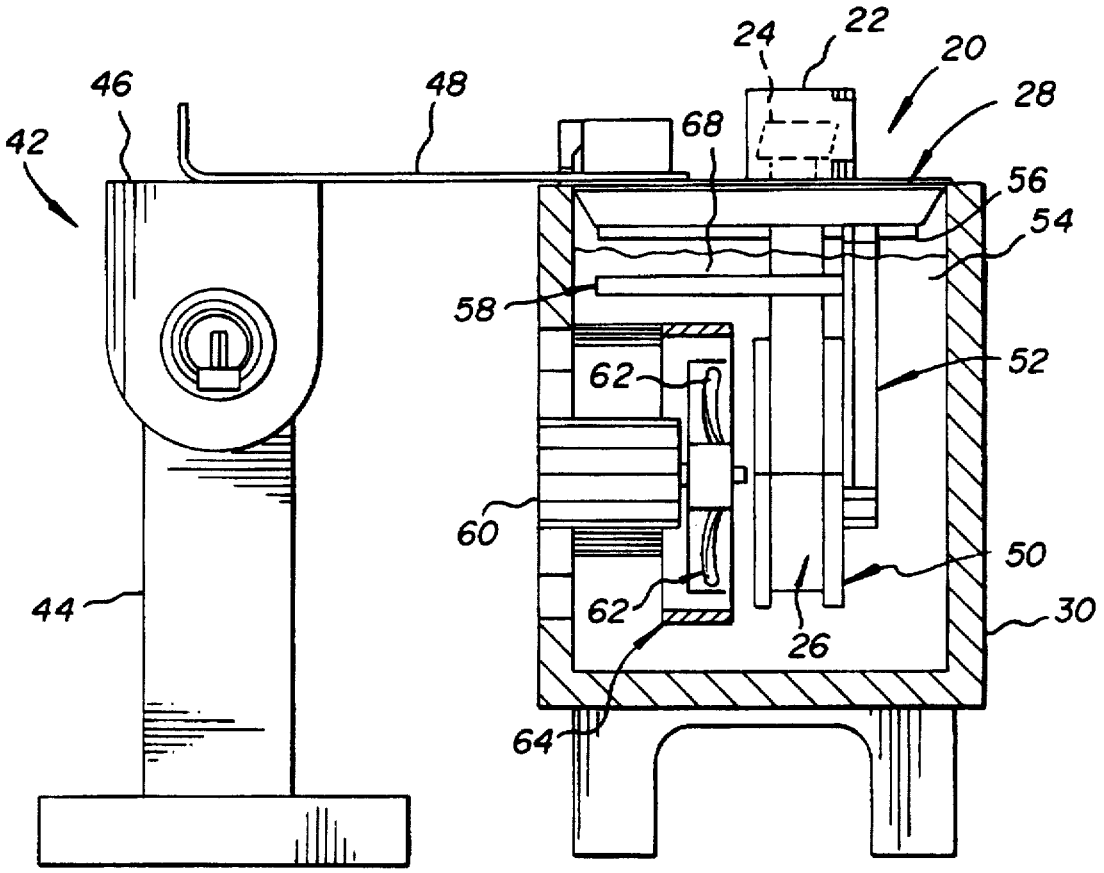
FIG. 2 is a partial sectional view of the processing section of the apparatus of FIG. 1 illustrating one of the processing tanks, a reel assembly, and the transport mechanism for moving the reel assembly.
Figure 3:
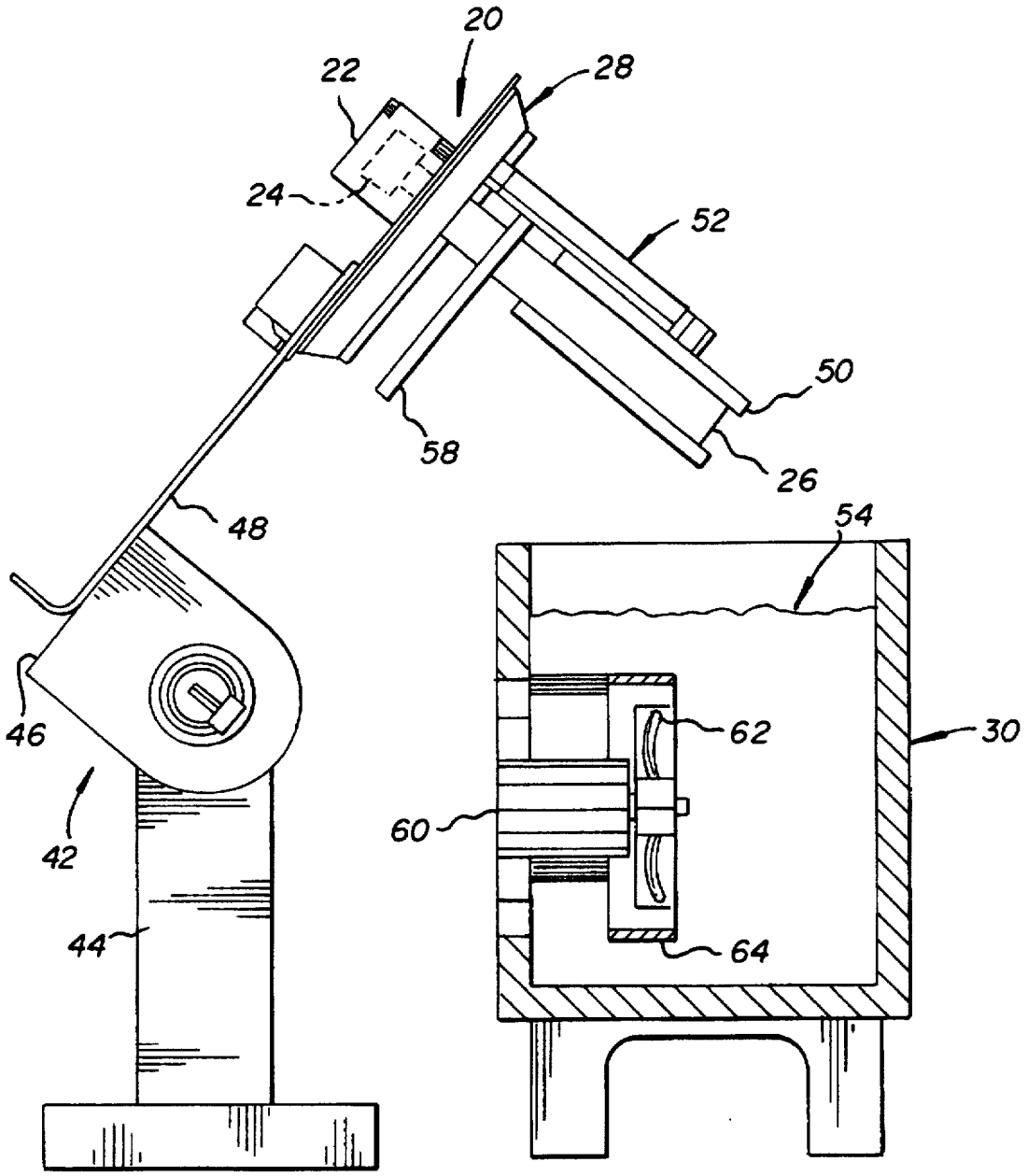
FIG. 3 is a view similar to FIG. 2 showing a cover and reel assembly in the out-of-tank position.

Referring to FIGS. 2 and 3, there is illustrated a holding mechanism 20 having a nest 22 for holding a filmstrip cartridge 24. The cartridge 24 is of the thrust-type and contains a filmstrip 26. The holding mechanism further includes a cover 28 designed to mate with at least one processing tank. In the embodiment illustrated, six processing tanks are provided (see FIG. 1). In particular, there is provided a development tank 30 which contains a photographic developer solution, a bleach tank 32 containing a photographic bleach solution, a first wash tank 34 containing a wash solution, a fix tank 36 containing a fixing solution, a second wash tank 38 containing a wash solution, and a stabilizer tank 40 containing a stabilizing solution. It is, of course, understood that any desired number of processing tanks may be provided, each containing the desired processing solution.

A transport mechanism 42 is provided for transporting the holding mechanism 20 through each of the processing tanks 30,32,34,36,38,40. The transport mechanism includes a base 44 secured to apparatus 10, a mounting block 46 which is rotatably mounted to base 44, and a lift member 48 having one end secured to mounting block 46 and the other end secured to holding mechanism 20. The mounting block 46 is mounted to base 44 such that the holding mechanism 20 may be rotated between an operative position (as shown in FIG. 2) and the transport position (as illustrated in FIG. 3). The mounting block 46 is also capable of being moved in a direction such that the holding mechanism 20 will be moved to a position adjacent to each of the processing tanks 30,32,34,36,38,40. Further details of the transport mechanism 42 and holding mechanism 20 is set forth in previously referred to U.S. Pat. No. 5,543,882.

Figure 10:
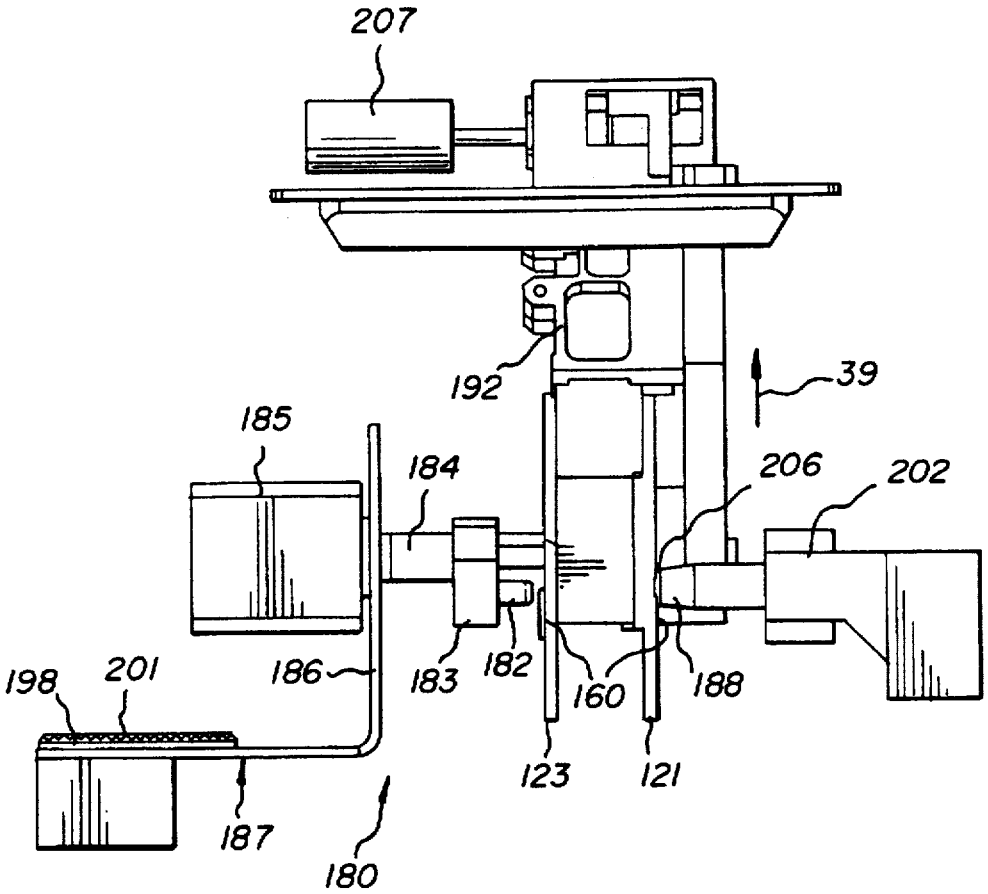
FIG. 10 is a front elevational view of FIG. 9.
Figure 9:
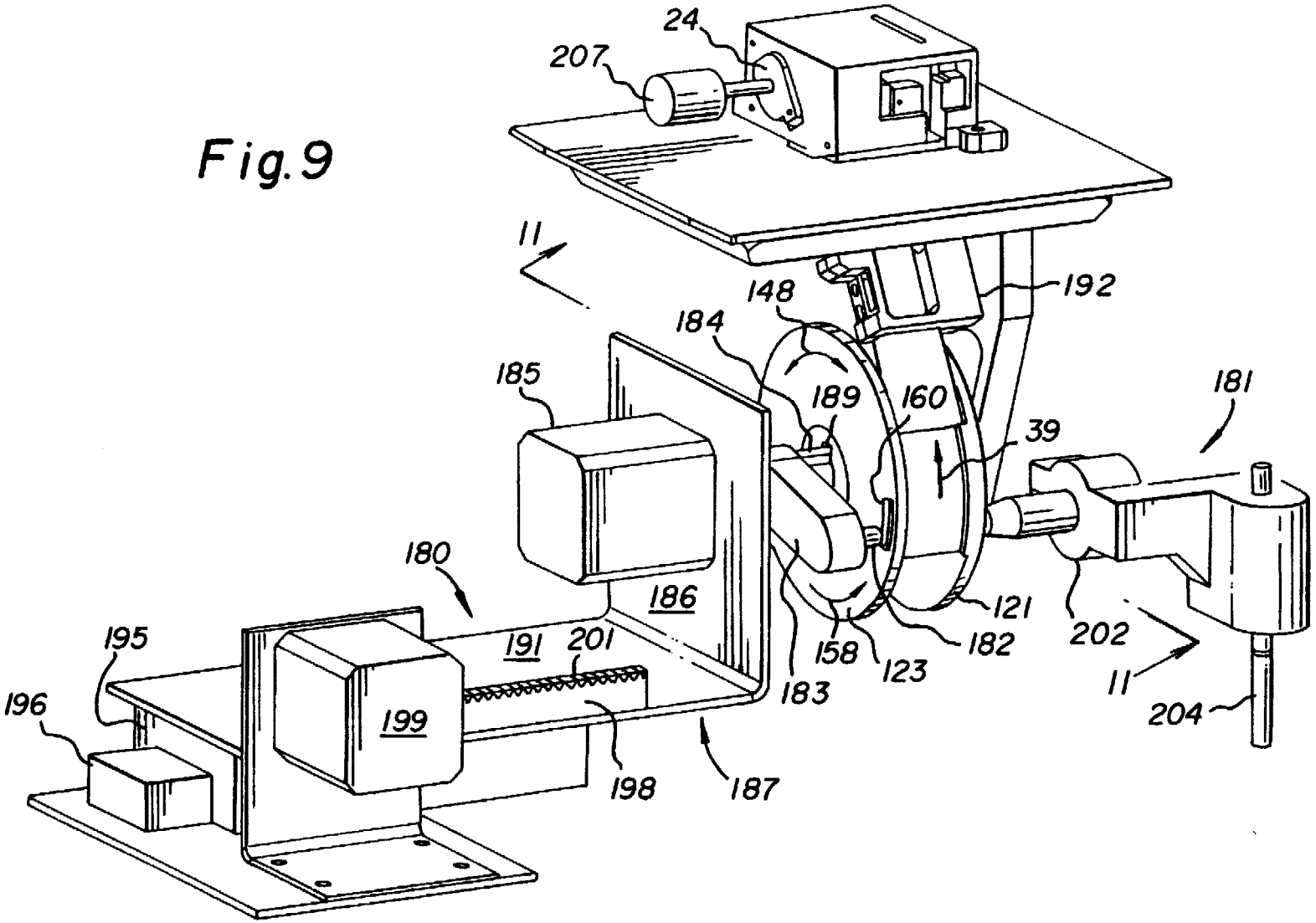
FIG. 9 is a perspective view of the cover, reel assembly, and motor at the load/unload station.
Figure 11:
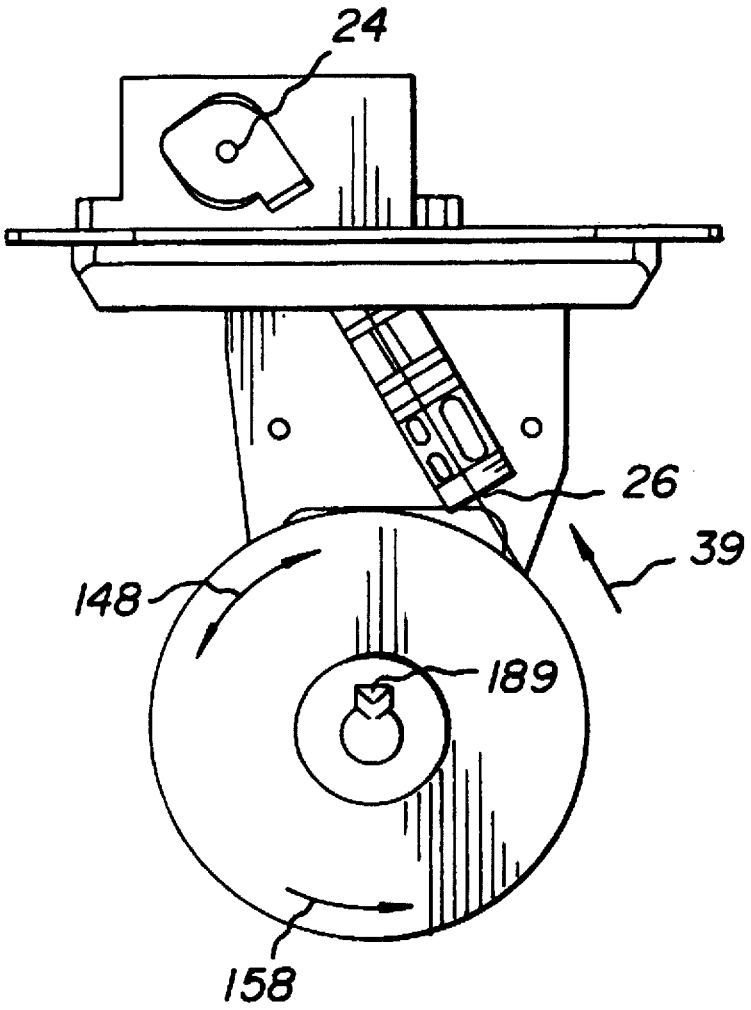
FIG. 11 is a side elevational view of FIG. 9 as taken along line 11—11.

The holding mechanism 20 further includes a filmstrip processing reel 50 which is used to hold the portion of filmstrip 26 that has been thrust out of cartridge 24 at load/unload station 12. The filmstrip 26 is held in a spiral pattern in reel 50 such that the processing solution can flow between adjacent convolutions of the filmstrip while it is transported through the desired sequence of processing tanks. A support arm 52 connects reel 50 with tank cover 28. Fluid 54 fills tank 30 to a level between the top of reel 50 and the bottom 56 of tank cover 28. Appropriate means, as shown in FIGS. 9–11, is provided for thrusting the portion of filmstrip 26 to be processed out of the cartridge 24 and into reel 50 and then back into cartridge 24, and as more fully described in U.S. Pat. No. 5,543,882. The trailing end portion of filmstrip 26 remains attached to cartridge 24 as it is being processed. A baffle 58 is attached to support arm 52 and placed above reel 50, but below the top level of fluid 54. A slot (not shown) is provided for allowing the filmstrip 26 to pass through baffle 58 and onto reel 50.

In the embodiment illustrated, means are also provided for agitating and passing the processing solution adjacent the surface of the filmstrip While in reel 50. In particular, there is provided a motor 60 having a propeller 62 for providing agitation and causing the processing solution 54 to pass through openings 53 in the side walls of the reel 50 such that the processing solution 50 is continuously allowed to flow past the emulsion placed on the filmstrip 26. The cover 28 mates with the upper end of the tank so as to provide a substantially sealed processing tank, such that when the motor 60 is activated, the processing solution will be maintained within the processing tank. A shroud 64 is provided around the periphery of propeller 62 so as to direct the processing solution to reel 50.

Figure 5:
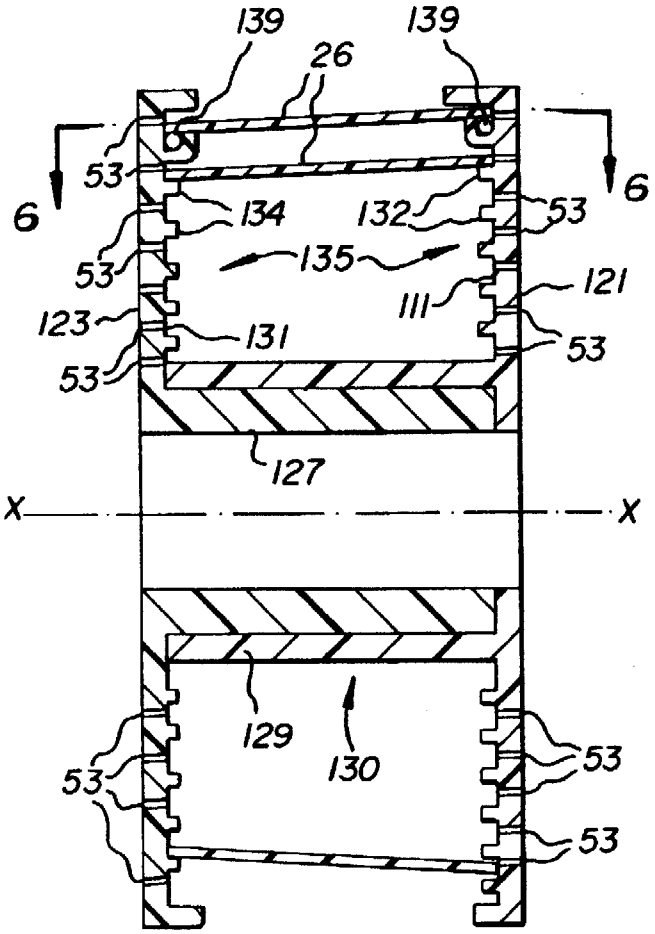
FIG. 5 is a cross-sectional view of the reel of FIG. 4 as taken along line 5—5 of FIG. 4.
Figure 4:
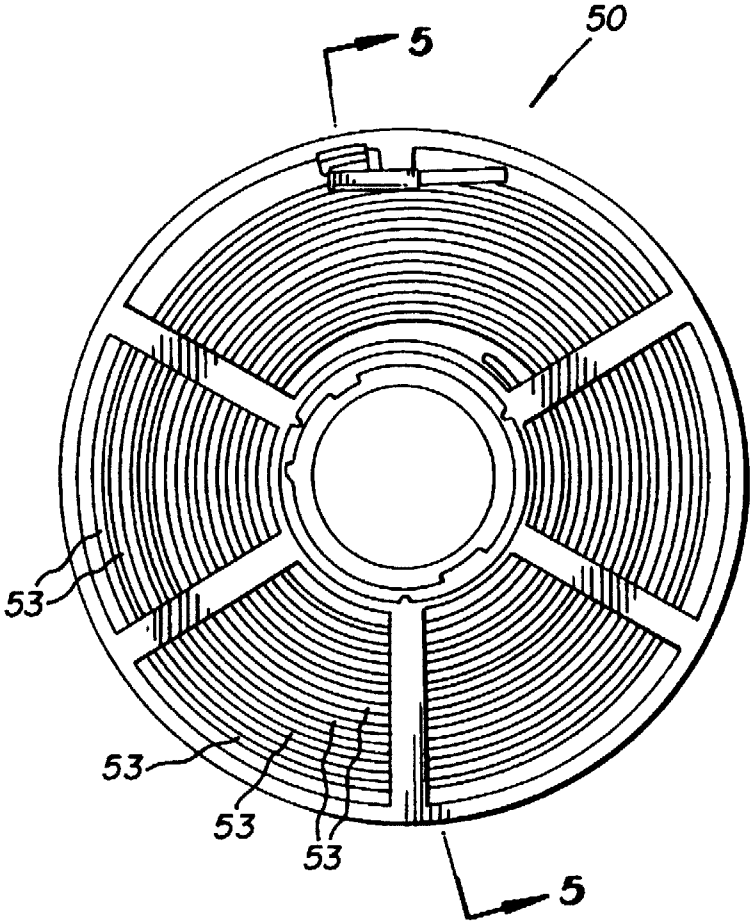
FIG. 4 illustrates a side elevational view of a processing reel made in accordance with the processing reel for use in the apparatus of FIG. 1.

Referring to FIGS. 4–8, there is illustrated in greater detail the processing reel 50. The processing reel 50 includes a pair of substantially parallel side walls 121,123. Side wall 123 has an annular inner projection 127 which extends therefrom and mates with an annular outer projection 129 extending from side wall 121 so as to form a central hub in reel 50. The inner surfaces 111,131 of side walls 121,123 facing each other are each provided with a projecting wall member 132,134, respectively. The wall members 132,134 on each respective side wall 121, 123 are provided in a substantially spiral pattern about hub 130 and are aligned with respect to each other so as to form a spiral path 135 for receiving the side edges 139 of a photosensitive material, such as a filmstrip 26, as illustrated in FIG. 5. The side walls 121,123, through annular portions 127,129, are mounted to each other such that a rotating reciprocating motion about axis x—x is provided between walls 121,123. In the particular embodiment illustrated, the side wall 123 is allowed to oscillate back and forth approximately 30° with respect to side wall 121.

Figure 7:
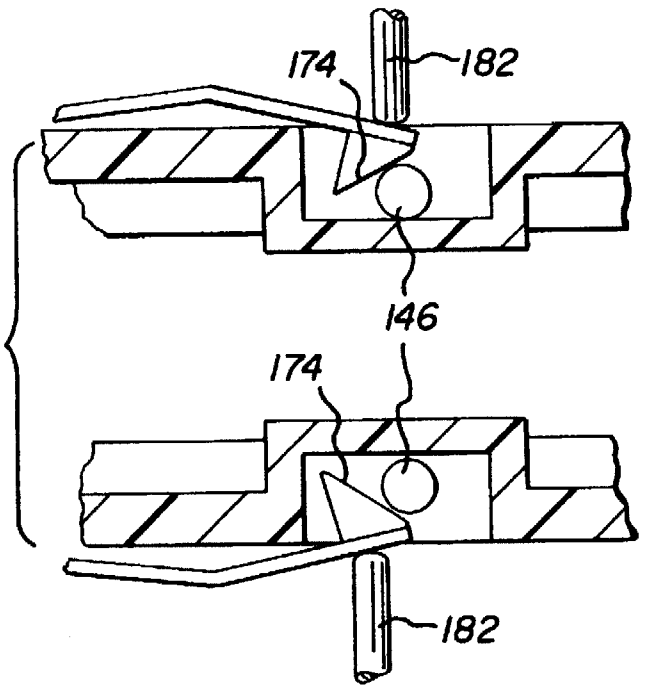
FIG. 7 is a view similar to FIG. 6 illustrating the clutch disengaging mechanism in the engaged position.
Figure 6:
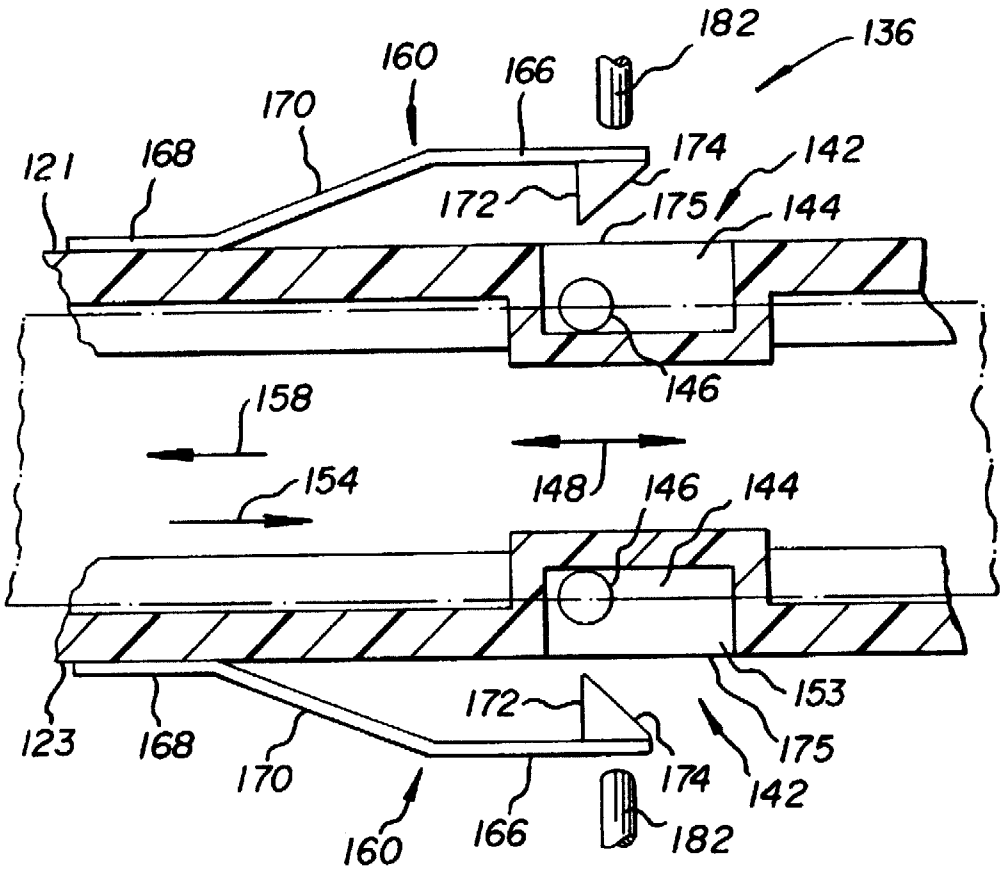
FIG. 6 is a cross-sectional view of the reel as taken along line 6—6 of FIG. 5 illustrating the clutch disengaging mechanism in the unengaged position.
Figure 8:
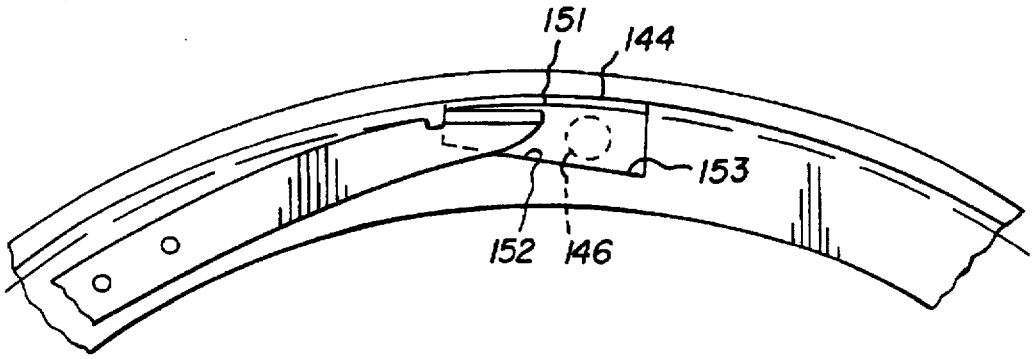
FIG. 8 is a side view of the top portion of the reel of FIG. 6.

Referring to FIGS. 6–8, each of the side walls 121,123 are provided with a clutch mechanism 136 such that when the side walls are reciprocated in one direction relative to each other, the filmstrip will be advanced through spiral path 135, and when oscillated in the opposite circumferential direction, will prevent movement of the photosensitive material out of path 135. In particular, the clutch mechanism includes a cage 144 designed to receive a spherical member/ball 146. In the particular embodiment illustrated, spherical member 146 is a steel ball. The cage 144 is configured and sized such that the ball 146 is trapped within cage 144 and can be moved only along the circumferential direction as illustrated in FIG. 6 by arrow 148. The clutch mechanism includes a ramp surface 152 within cage 144. The ramp surface 152 is designed such that when the photosensitive material is moved in the direction indicated by arrow 154, the filmstrip will be caught between the top surface of the ball 146 and outer wall 151 causing it to be moved in a direction in which the wall member is being oscillated, and when one wall member is moved in the opposite direction with respect to the other side as indicated by arrow 158, the ball member 146 will be at the lower end 153 of ramp 152, as illustrated by dash line in FIG. 8, thus allowing movement of one of the side walls 121,123 without moving the filmstrip 26. If the filmstrip 26 is pulled in a direction to remove the filmstrip 26 from the spiral path 135 as indicated by arrow 154, the balls in each of the cages will prevent the filmstrip 26 from being pulled out.

In the prior art, in order to allow the filmstrip 26 to be removed from the spiral path 135, a clutch disengaging means is provided for disengaging of the balls 146 from the filmstrip 26 when the filmstrip 26 is moved in the direction indicated by arrow 158 (see FIG. 11). In the embodiment illustrated, there is provided a pair of spring members 160, one associated with each of the cages 144 having a forward engaging portion 166 and a rear end 168 which is secured to the associated wall members 121,123. It is to be understood that the rear end 168 may be secured in any desired manner, for example, means such as screws, adhesive, rivets, etc. Each spring member 160 has a central portion 170 which extends in a direction outwardly from adjacent wall members 121,123 and terminates in forward end 166. Forward end 166 is provided with a projecting portion 172 which has an engaging surface 174 which can pass through an access opening provided in cage 144. The surface 174 is configured so as to engage the ball 146 and thereby force the spherical ball 146 to be retained at the lower end portion 153 of the ramp surface 152 so that the filmstrip 26 will not engage ball 146 as it is moved in the removal direction.

Referring to FIGS. 9, 10, and 11, there is illustrated actuation mechanisms 180,181 located at station 12 for engaging and disengaging surfaces 174 with balls 146. In the embodiment illustrated, mechanism 180 comprises a projecting member 182 which is secured to the end of arm 183 which is secured to the drive shaft 184 of motor 185. Motor 185 is mounted to the upper section 186 of L-shaped member 187. The shaft 184 is keyed and engages a correspondingly shaped opening 189 in inner projection 127 of side wall 123 of reel 50. The motor 185 is used to oscillate side wall 123 of reel 50. The L-shaped member 187 has a base section 191 which is secured to slide block 195 which is slideably mounted to slide projection 196 which is secured to the frame of apparatus 10 by any conventional means. A rack 198 is provided on base section 191 having teeth 201 which engage a gear (not shown) which is driven by motor 199 which is also secured to the frame of apparatus 10. By activating motor 199 in the appropriate direction, the L-shaped member will be caused to be moved toward or away from reel 50, causing projecting member 182 to engage or disengage spring member 160, causing the ball 146 to freely move within cage 144 or force the ball 146 to be retained in the lower portion of the cage for allowing removal of the filmstrip 26.

Mechanism 181 is used to engage and disengage the spherical ball 146 in side wall 121. Mechanism 181 comprises an arm 202 mounted to rod 204 which is rotatably mounted to the apparatus 10. A projecting member 206 is provided for engaging spring member 160 on side wall 121. By rotating rod 204, by any desired means, such as a motor or circular solenoid, member 206 can engage or disengage spring member 160 causing the spherical member 146 to be free within cage 144 or retained at the lower end for allowing removal of the filmstrip out of the reel 50 in the direction indicated by arrow 39.

After the filmstrip 26 has been properly developed and dried, it is returned to the load/unload station 12 where the filmstrip 26 is rewound back into the cartridge 24. Applicants have found that simply pulling of the filmstrip, for example, by rotating of the spool in the thrust cartridge 24, will result in the edges of filmstrip 26 binding on the ridges in the side walls 121,123 of the reel 50. Applicants have found that by simply oscillating one of the side walls with respect to the other side wall, this will release any binding forces experienced during withdrawal of the filmstrip from the reel 50.

After the filmstrip 26 has been developed and returned to station 12, the filmstrip 26 is rewound back into the cartridge 24. Motor 199 is activated so as to move the L-shaped member toward the reel 50 so that projection 182 engages spring 160. At the same time, rod 204 is rotated so that projection 206 engages spring 160 on side wall 121. The filmstrip 26 is then rewound back into the cartridge 24 by applying a removal force to the rear end of the filmstrip 26. A motor 207 rotates the spool of the cartridge. This causes the filmstrip 26 to exit reel 50 through guide 192 into the cartridge 24. Motor 207 is initially used to thrust the filmstrip 26 out of the cartridge and into the reel prior to processing. As previously noted, binding of the filmstrip edges with the projections may result during rewinding of the filmstrip 26 back into the cartridge 24. In order to avoid this binding, simultaneously, as a rewinding force is applied to the filmstrip 26 by motor 207, one of the side walls of reel 50 is oscillated in a direction indicated by arrow 148 such that this releases any tensioning forces between the edges of the filmstrip 26 and the spiral ridges. In particular, motor 185 is appropriately activated for oscillating side wall 123 with respect to side wall 121. Preferably, oscillation of the side wall 123 occurs at the same time or prior to applying the rewinding force on the trailing end of the filmstrip 26 so as to prevent cinching of the filmstrip to the reel. Also, the direction of the first oscillation is preferably in the direction for rewinding as indicated by arrow 158.

The present invention provides an improved method for reducing friction forces between the filmstrip and the reel as the filmstrip is being withdrawn therefrom.

It is to be understood that various other modifications and changes may be made without departing from the scope of the present invention, the present invention being defined by the following claims.

Parts List:

10 . . . processing apparatus
12 . . . load/unload station
14 . . . filmstrip processing section
16 . . . drying section
18 . . . housing
20 . . . holding mechanism
22 . . . nest
24 . . . filmstrip cartridge
26 . . . filmstrip
28 . . . cover
30 . . . development tank
32 . . . bleach tank
34 . . . first wash tank
36 . . . fix tank
38 . . . second wash tank
39 . . . arrow
40 . . . stabilizer tank

42 . . . transport mechanism
44 . . . base
46 . . . mounting block
48 . . . lift member
50 . . . filmstrip processing reel
52 . . . support arm
53 . . . openings
54 . . . processing fluid
56 . . . bottom
58 . . . baffle
60 . . . motor
62 . . . propeller
64 . . . shroud
111,131 . . . inner surfaces
121,123 . . . side walls
127,129 . . . annular portions
130 . . . hub
132,134 . . . projecting wall members
135 . . . spiral path
136 . . . clutch mechanism
139 . . . side edges
142 . . . disengaging clutches
144 . . . cage
146 . . . spherical member/ball
148,154,158 . . . arrow
152 . . . ramp surface
151 . . . outer wall
153 . . . lower end portion
160 . . . spring members
166 . . . forward end portion
168 . . . rear end
170 . . . central portion
172 . . . projection portion
174 . . . engaging surface
180,181 . . . actuation mechanism
182 . . . projecting member
183 . . . arm
184 . . . drive shaft
185 . . . motor
186 . . . upper section
187 . . . L-shaped member
189 . . . opening
191 . . . base section
192 . . . guide
195 . . . slide back
196 . . . slide projection
198 . . . rack
199 . . . motor
201 . . . teeth
202 . . . arm
204 . . . rod
206 . . . member
207 . . . motor

We claim:

1. A method of retracting a filmstrip wound on a filmstrip reel back into an attached film cartridge, said filmstrip having a rear end attached to a spool of the film cartridge, said reel comprising a pair of side walls, each side wall having a spiral track for retaining an edge of the filmstrip, the method comprising the steps of:

a) applying a removing force on the rear end of said filmstrip in a direction for rewinding the filmstrip into said film cartridge; and b) oscillating one of said side walls with respect to the other side wall about its central axis simultaneously as said filmstrip is being rewound into said film cartridge.

2. A method according to claim 1 wherein a first oscillation motion of said side wall is in the same direction in which the filmstrip is to be retracted from said filmstrip reel.

3. A method according to claim 1 wherein said first oscillation occurs prior to applying said force for rewinding of said filmstrip.

* * * * *